United States Patent [19]

Grunder et al.

[11] Patent Number: 4,864,853

[45] Date of Patent: Sep. 12, 1989

[54] APPARATUS FOR MEASURING THE THICKNESS OF FIBRE SLIVERS

[75] Inventors: Werner Grunder, Mönchaltorf; Francois Baechler, Uster; Erwin Murbach, Nänikon-Uster, all of Switzerland

[73] Assignee: Zellweger Uster Ltd., Switzerland

[21] Appl. No.: 107,588

[22] PCT Filed: Jan. 14, 1987

[86] PCT No.: PCT/CH87/00003

§ 371 Date: Oct. 16, 1987

§ 102(e) Date: Oct. 16, 1987

[87] PCT Pub. No.: WO87/04472

PCT Pub. Date: Jul. 30, 1987

[30] Foreign Application Priority Data

Jan. 16, 1986 [CH] Switzerland ..... 0156/86

[51] Int. Cl.[4] ..... D01H 5/32

[52] U.S. Cl. ..... 75/160; 73/37.7; 19/240

[58] Field of Search ..... 73/159, 160, 37.7, 37.9, 73/861.52, 37.5, 37.6, 37; 57/264, 265; 19/157, 239, 242, 150, 300, 240

[56] References Cited

U.S. PATENT DOCUMENTS

| | | | |
|---|---|---|---|
| 3,722,260 | 3/1973 | Staheli | 73/37.7 |
| 3,752,170 | 8/1973 | Murbach | 73/160 |
| 3,822,590 | 7/1974 | Tharpe et al. | 73/160 |
| 3,854,330 | 12/1974 | Wildbolz | 73/160 |
| 3,990,292 | 11/1976 | Stern | 73/37.7 |
| 4,184,361 | 1/1980 | Erben | 73/37.7 |
| 4,199,844 | 4/1980 | Goetzinger | 19/240 |
| 4,302,968 | 12/1981 | Moser | 73/160 |
| 4,306,450 | 12/1981 | Moser | 73/160 |
| 4,318,299 | 3/1982 | Morf | 73/160 |
| 4,764,876 | 8/1988 | Whitener et al. | 73/160 X |

*Primary Examiner*—William M. Shoop, Jr.
*Assistant Examiner*—Paul Ip
*Attorney, Agent, or Firm*—Burns, Doane, Swecker & Mathis

[57] ABSTRACT

The apparatus comprises a compression member (T) and a measuring device arranged thereon for measuring the thickness of a fibre sliver passing through a measuring duct (4). The measuring device is formed by a leaf spring (BF) provided with resistance strain gauges. The measuring duct (4) is provided in a measuring member (MT) arranged removably on the sliver hopper (T) and the measuring member is equipped with a compressed air nozzle (19).

Simple range adaptation to varying sliver numbers can thus be effected, on the one hand, and the measuring member can easily be cleaned and cooled, on the other hand.

25 Claims, 7 Drawing Sheets

APPARATUS FOR MEASURING THE THICKNESS OF FIBRE SLIVERS

DESCRIPTION

The invention relates to an apparatus for measuring the thickness and the irregularity of fibre slivers, preferably on machinery used in preparation for spinning, with a compression member compressing the fibre sliver and with a measuring device which is arranged thereon, mechanically scans the compressed fibre sliver in a measuring duct and is formed by a leaf spring provided with a resistance strain gauge for measuring the thickness and the irregularity of the fibre sliver.

With an apparatus of this type described in DE-PS 15 10 487, the measuring duct is provided in a wall integrally connected to the outlet opening of the compression member formed by a sliver hopper and the leaf spring is fixed on the sliver hopper and extends along a generatrix of the sliver hopper.

This produces a certain amount of inertia in the measuring device. Moreover, the entire sliver hopper invariably has to be exchanged for adaptation to varying numbers of slivers.

Accordingly, this known apparatus is to be improved by the invention in that even very short irregularities can be measured at a high sliver speed and in that simple adaptation of the range to varying numbers of slivers can be effected.

This object is achieved according to the invention in that the measuring duct is provided in a measuring member arranged removably on the compression member and in that the measuring member is equipped with a compressed air nozzle.

The arrangement of the measuring duct in a removable measuring member on the compression member has the advantage that, for adaptation to varying numbers of slivers, it is no longer necessary to exchange the entire compression member but merely the named component or even only part thereof. The compressed air nozzle allows settling dust to be blown out and/or allows the measuring station to be cooled.

An embodiment of the invention is described in more detail below with reference to the drawings.

Figure 6A:
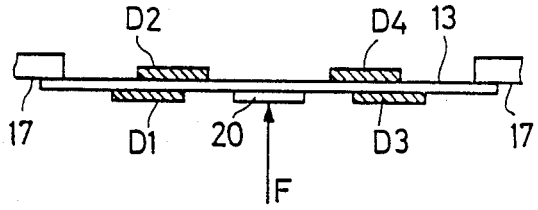
Figure 6A:
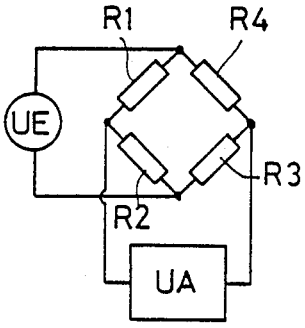

FIG. 6*a* shows a schematic illustration to describe operation.

Figure 7:
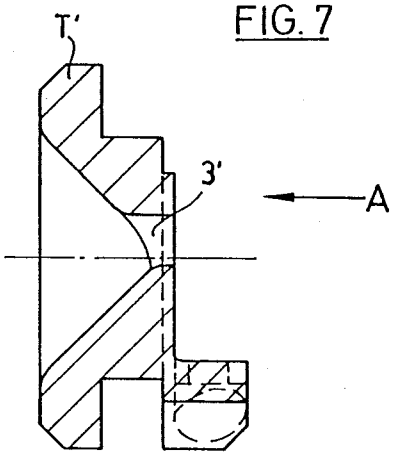

FIG. 7 shows a longitudinal section through a second embodiment of a sliver hopper.

Figure 8:
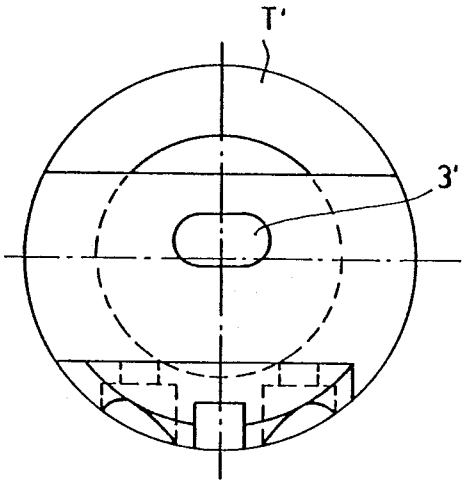

FIG. 8 shows a view in the direction of the arrow A in FIG. 7.

Figure 9:
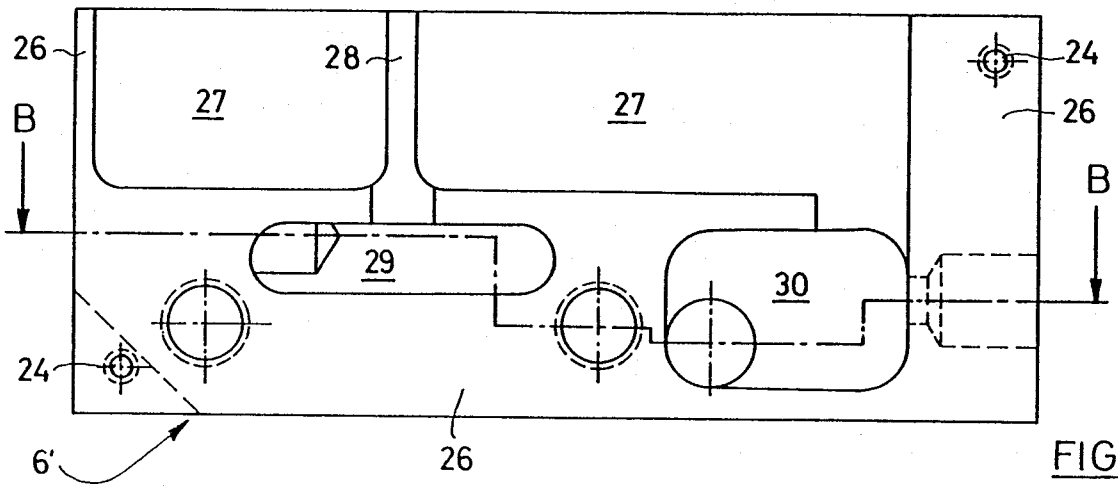

FIG. 9 shows a plane view of the stop part of a measuring member suitable for the sliver hopper in FIG. 7.

Figure 10:
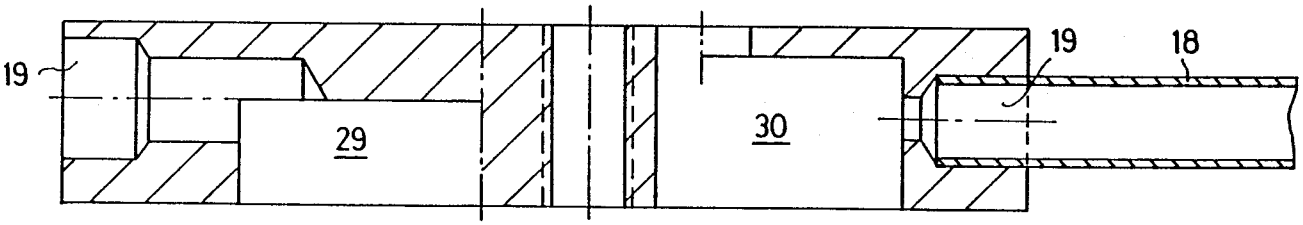

FIG. 10 shows a section along the line B—B in FIG. 9.

Figure 11:
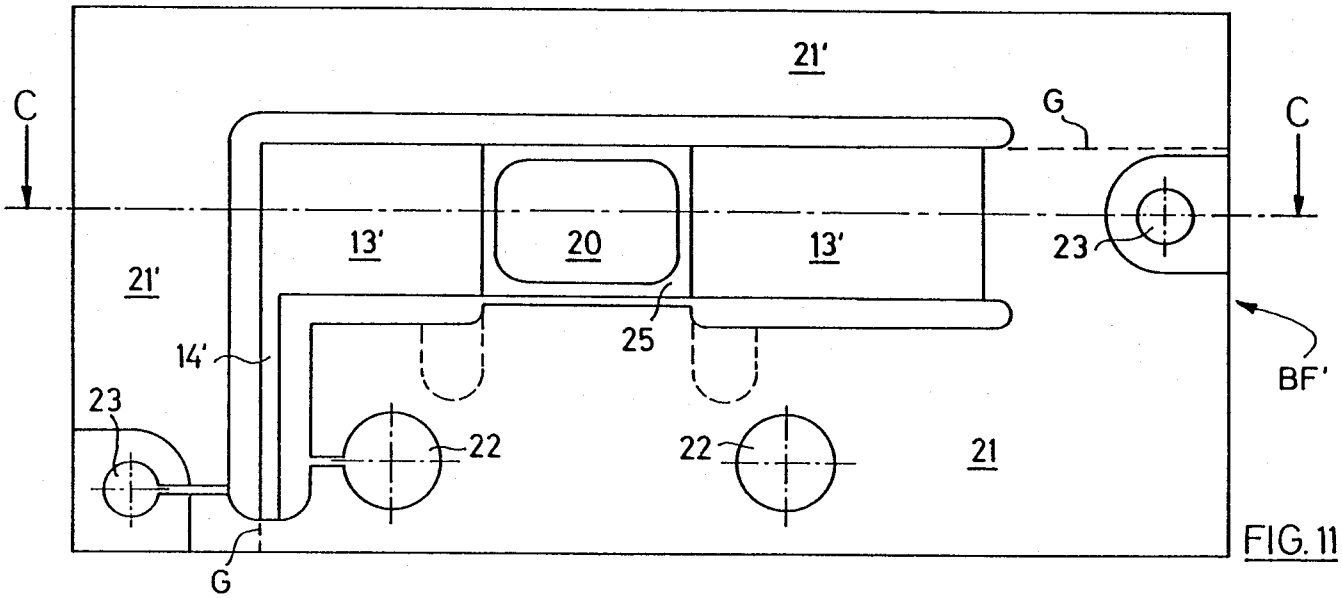

FIG. 11 shows a plane view of a leaf spring with its support.

Figure 12:
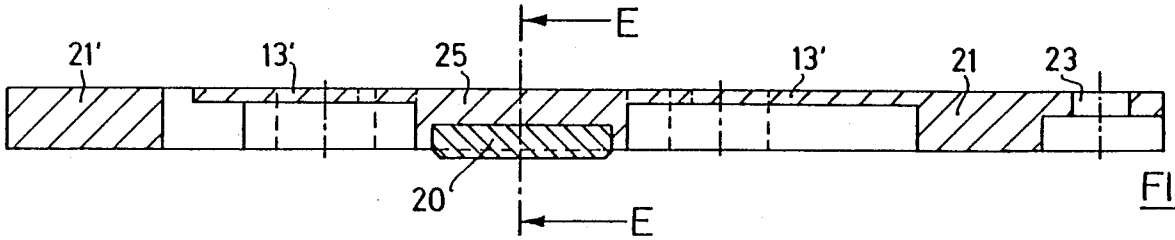

FIG. 12 shows a section along the line C—C in FIG. 11.

Figure 13:
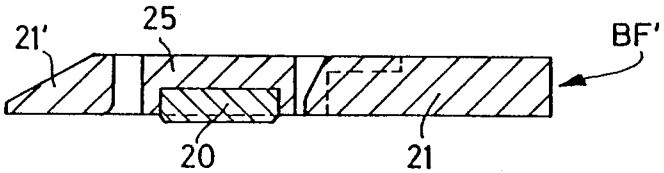

FIG. 13 shows a section along the line E—E in FIG. 12.

Figure 1:
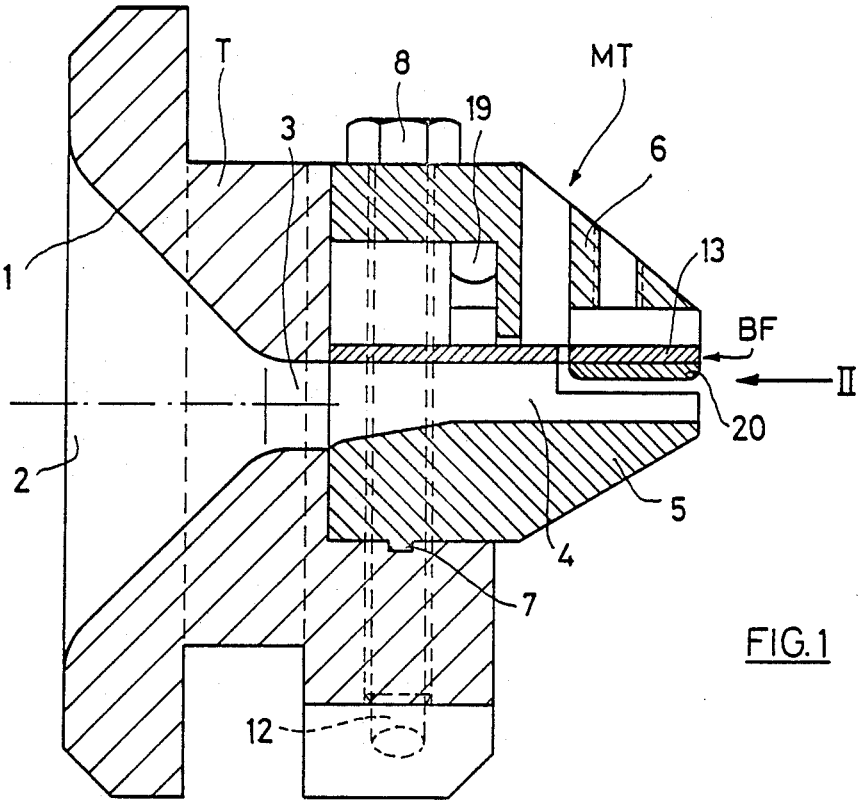
FIG. 1 shows a longitudinal section through a first embodiment of a sliver hopper with a measuring device.
Figure 2:
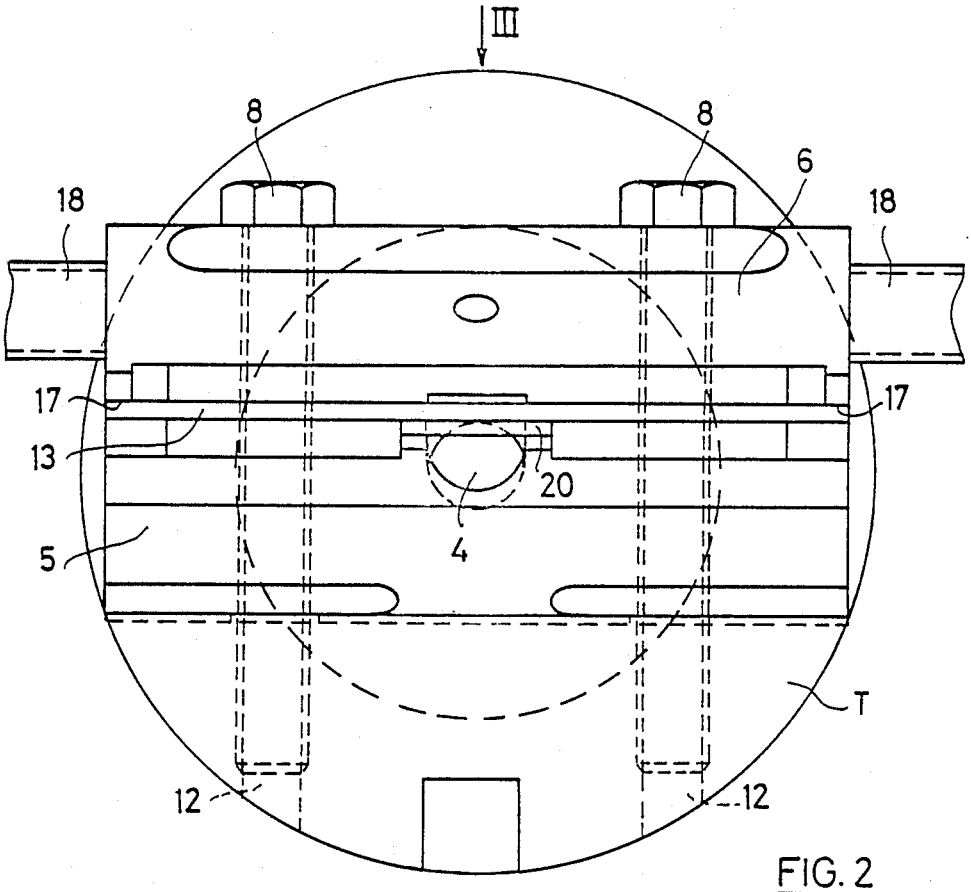
FIG. 2 shows a view in the direction of the arrow II in FIG. 1.
Figure 3:
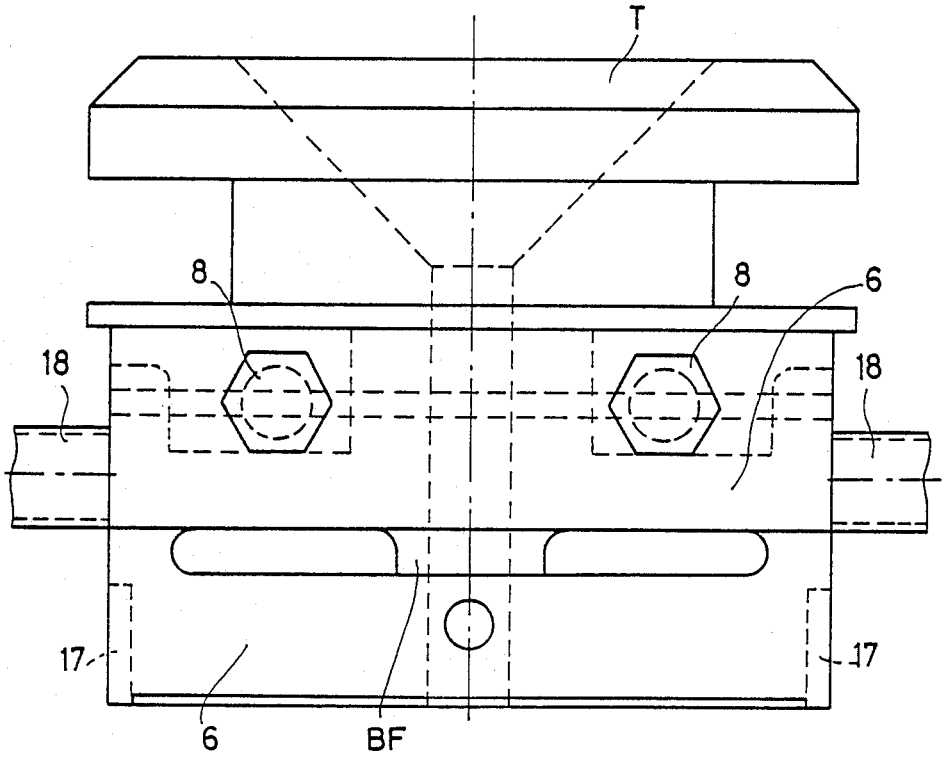
FIG. 3 shows a view in the direction of the arrow III in FIG. 2.

FIGS. 1–3 show a first embodiment of a sliver hopper T for compressing a fibre sliver with a hopper wall 1 and an inlet opening 2 and outlet opening 3. Sliver hoppers of this type are known and are used, in particular, on draw-frames or carding engines. On draw-frames they are used, for example, after the drawing rollers and/or before a pair of calender rollers in the direction of passage. In carding engines, the sliver hopper may be connected, for example, to the can or it may be provided for collecting the card web.

Adjacent to the outlet opening 3, the sliver hopper T has a slope into which a measuring member MT having a measuring duct 4 is inserted. The measuring member MT consists of two parts, a duct part 5 and a stop part 6 between which a leaf spring BF is fixed. The leaf spring BF serves as measuring device for measuring the thickness of a fibre sliver running through the sliver hopper 1 and the measuring duct 4.

Figure 4:
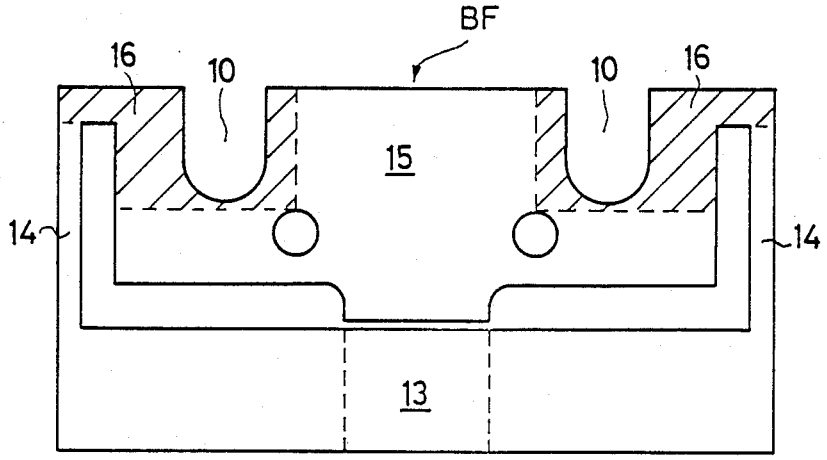
FIGS. 4 to 6 show details of the measuring member from FIGS. 1 to 3.
Figure 5:
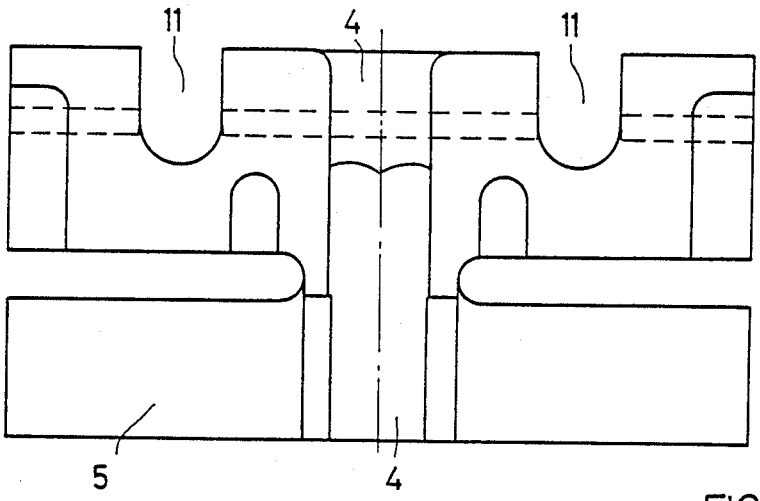
Figure 6:
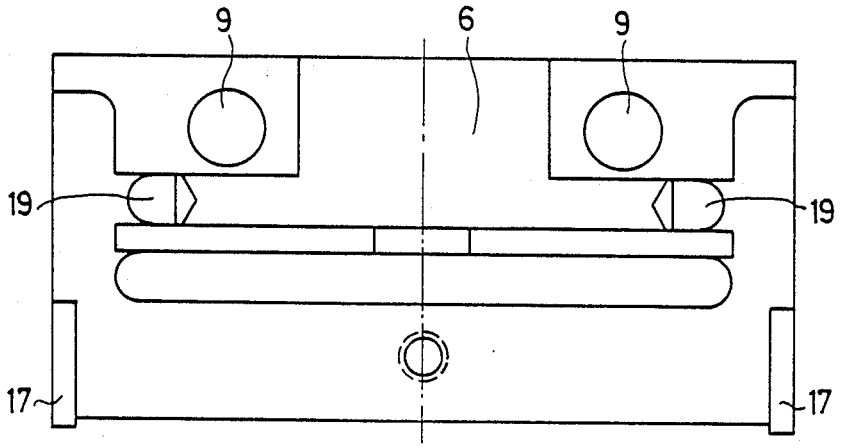

FIG. 4 shows a view of the leaf spring BF, and FIGS. 5 and 6 each show a view of the clamping face of the duct part 5 or the stop part 6 facing the leaf spring BF. The design of the measuring member MT will now be described with reference to FIGS. 1 to 6, a scale of 4:1 being used in each case.

The duct part 5 has an approximately plate-shaped configuration and has on its clamping face the measuring duct 4 which is provided with a conical inlet portion and is formed by a groove in the duct part 5. On the opposing face, the duct 5 is provided with a centering ridge 7 which runs transversely to the measuring duct 4 and catches in a corresponding groove in the slope of the sliver hopper T. The duct part 5 and, with it, the entire measuring member MT is thus fixed in two co-ordinate directions relative to the sliver hopper T. It is fixed in the third co-ordinate direction, that is the direction perpendicularly to the plane of the drawing in FIG. 1, by means of two bolts 8 which are pushed through corresponding holes 9 in the stop part 6 and slots 10 and 11 in the leaf spring BF and in the duct part 5 and are screwed into threaded holes 12 in the sliver hopper T.

As the bolts 8 simultaneously serve to fix the measuring member MT on the sliver hopper T, the measuring member can be exchanged merely by releasing and pulling the bolt 8 so the apparatus composed of the sliver hopper T and the measuring member MT can easily be adapted to varying numbers of slivers.

As illustrated (in particular in FIG. 4) the leaf spring BF consists of a measuring beam 13 and of two torsion rods 14 by means of which the measuring beam 13 is fixed on a connecting part 15. The leaf spring BF composed of these parts is produced in one piece and is clamped at the two positions 16 marked by hatching in FIG. 4 in the transition region between connecting part 15 and torsion rods 14 between duct part 5 and stop part 6. The measuring beam 13 of the leaf spring BF lies transversely over the measuring duct 4 and is thus prevented from pivoting out of the measuring duct 4 at its ends by two contact faces 17 of the stop part 6.

A fibre sliver issuing from the sliver hopper 1 and running through the measuring duct 4 is compressed by the measuring beam 13 in the measuring duct 4 and produces on the measuring beam 13 a pressure whose absolute value increases reproducibly as the sliver thickness increases. Any change in the sliver thickness causes a corresponding change in this pressure and in the force acting on the measuring beam 13. Owing to the stop face 17, the measuring beam 13 cannot pivot out of the measuring duct 4 but is deflected, and a positive extension is produced on one surface of the measuring beam 13 and a negative extension on the other surface, these extensions being proportional to the effective force and therefore being a gauge of the sliver thickness. The mechanical extension value is converted into an electrical value by means of resistance strain gauges arranged on the measuring beam 13 (see FIG. 6*a*).

As shown, in particular, in FIG. 2, the contact faces 17 lie less than 1 mm in front of the web of the stop part 6 connecting them. The maximum possible deflection of the measuring beam 13 is therefore restricted to this distance and said web between the two contact faces 17 acts as a stop against over-extension and over-stressing.

As seen in FIGS. 2 and 3, a respective small tube or nipple 18 is provided on the stop part 6 on both lateral walls transversely to the measuring duct 4 of the duct part 5. The small tubes are each fixed in a hole 19 penetrating the corresponding lateral wall. One of the small tubes 18 serves for supplying the electrical connections and the other allows simple cooling and cleaning of the measuring member by means of compressed air. Cleaning is effected by an intermittent supply of compressed air and cooling by a continuous supply of compressed air.

The two torsion rods 14 which position the measuring beam 13 and determined its pivot point also fulfil the other important object of preventing the clicking effect when the measuring beam 13 is locally heated by the passing fibre sliver and thus prevent the occurrence of mechanical stresses due to temperature variations. To prevent the measuring beam 13 from being worn out by the fibre sliver, it is provided on its side which makes contact with the fibre sliver with a pressure plate 20 which is composed of hard metal or ceramic material and is applied to the measuring beam 13. In addition to the resistance strain gauge, a temperature sensor for measuring any temperature variations can also be provided on the measuring beam 13 or in the region thereof.

FIG. 6*a* shows the basic arrangement of the resistance strain gauge on the measuring beam 13 and the evaluation of its signals. The Figure shows schematically the measuring beam 13 which is supported against the stop faces 17 and on whose pressure plate 20 a force F would act due to a fibre sliver. To evaluate the resultant extension on both surfaces of the measuring beam 13, two respective resistance strain gauges D1 and D3 or D2 and D4 are arranged thereon.

The resistance strain gauges lie symmetrically to the imaginary point of action by the force F in the centre of the measuring duct 4 (FIG. 5). This ensures that interference caused by the ambient temperature or by local heating of the measuring beam 13 due to friction of the fibre sliver is completely compensated.

Each resistance strain gauge D1 to D4 has a specific electric resistor R1 to R4, these resistors all being identical. As the relative change in resistance during deflection of the measuring beam 13 is known to be proportional to the extension of the resistance strain gauge, the extension can be determined by measuring this change in resistance. This is effected by means of a Wheatstone bridge circuit composed of four branches which are formed by the resistors R1 to R4 connected in a ring. If a supply voltage UE is now applied to the junctions between the resistors R4 to R1, on the one hand, and R2 and R3 on the other hand, then it is possible to measure the output voltage UA which is proportional to the turning of the bridge at the other two junctions and which, in turn, is proportional to the sum of the extension of the individual resistance strain gauges D1 to D4.

As the measuring beam 13 is relatively short and has a high spring constant and a small mass, it has a very high inherent frequency and allows measurement of very short irregularities in the sliver thickness at high speeds of travel by the fibre sliver. Further advantages of the apparatus described are as follows:

Simple range adaptation of the sliver hopper 1 by exchange of the sliver guide means (duct part 5).

Possibility of arranging the measuring device very close to the take-off device.

Easy method of cleaning the measuring device.

Protection of the measuring device from external mechanical effects.

Protection of the measuring beam 13 from over-extension by mechanical stop.

Substantial independence of the measuring device from temperature variations.

Substantial independence of the measuring device from variations in the fibre fineness of the sliver.

FIGS. 7 to 13 show a second embodiment of a sliver hopper T' (FIGS. 7, 8), of a stop part 6' suitable for use therewith (FIGS. 9, 10) and of a suitable leaf spring BF' (FIGS. 11 to 13). The scale in FIGS. 7 and 8 is 2:1 and in FIGS. 9 to 13 5:1.

The sliver hopper T' is basically the same as the sliver hopper T in FIGS. 1 to 3, the main difference from it residing in an outlet opening 3' of approximately oval or oblong cross-section. This form leads to a corresponding change in the cross-section of the fibre sliver so that the leaf spring no longer rests tangentially thereon but along one lateral face.

Adjacent to the outlet opening 3' the sliver hopper T' also has a slope into which a measuring device is inserted and fixed by bolts (not shown). Whereas the duct part 5 lies at the bottom and the stop part 6 at the top in the measuring member MT in the first embodiment (FIGS. 1 to 6) with respect to FIG. 1, this is reversed in the second embodiment in FIGS. 7 to 13. The stop part 6' (FIGS. 9, 10) thus lies directly on the slope of the sliver hopper T' and the duct part is arranged on top of it. The leaf spring BF' (FIGS. 11 to 13) is clamped between these two parts. Which of the two parts, duct part or stop part, lies directly on the slope of the sliver hopper T or T' is not essential to the invention, however.

The duct part of the second embodiment corresponds substantially to the duct part 5 (FIG. 1) of the first embodiment and is not therefore illustrated. On the other hand, there is a number of differences between the two embodiments with respect to stop part and leaf spring which will not be described with reference to FIGS. 9 to 13. As the leaf springs differ, in particular, the leaf springs will be described first of all.

As shown in FIGS. 11 to 13, the leaf spring BF' is composed substantially of a thicker support member 21 forming its edge portion and of a measuring beam 13' which is connected to the support member 21 directly at one of its ends and via a torsion rod 14' at its other end. As the leaf spring BF' is also produced from one piece, the term "connected" in this context obviously does not mean a connection between two different parts but the boundary between two regions of one and the same part. The leaf spring BF' has two holes 22 for fixing bolts corresponding to the bolts 8 (FIG. 1) for rough adjustment in the measuring member. Fine adjustment is effected by bolts (not shown) which are guided in a second pair of holes 23 and are screwed in corresponding threads 24 in the stop part 6' (FIG. 9).

The measuring beam 13' has a second region 25 with the pressure plate 20 in its region contacting the passing fibre sliver to be measured. The four resistance strain gauges are arranged on the face of the measuring beam 13' turned away from the pressure plate 20, preferably in the region between the thickened region 25 and the end of the measuring beam 13 passing into the support member 21.

The stop part 6' (FIGS. 9, 10) is suitably adapted to the leaf spring BF' and has at its edge an approximately U-shaped contact face 26 for the leaf spring BF' and in the region of the measuring beam 13' a slope 27 which is set back from the contact face 26. The slope 27 is split into two by a web 28 arranged in the region of the pressure plate 20 (FIG. 11). Although the web 28 projects beyond the slope 27, it is lower than the contact face 26 and forms a stop which limits the deflection of the measuring beam 13'.

As can be seen from FIGS. 9 and 10, the stop part 6' also comprises two chamber-like recesses 29 and 30. A respective hole 19 penetrating the relevant side wall of the stop part 6' opens into the chambers 29 and 30, and a small tube 18 is fixed in at least one of the holes 19. The electrical connections of the resistance strain gauges are guided outwards through this small tube 18 via chamber 30 and slope 27. A nipple (not shown) is fixed in the hole 19 opening into the chamber 29, through which compressed air is blown from the exterior into the stop part 6' to clean and cool the measuring station, the compressed air passing via chamber 29 and web 28 over the measuring beam 13'.

Comparison of FIGS. 9 and 11 shows that the leaf spring BF' has larger dimensions than the corresponding face of the stop member 6'. This is due to the fact that the leaf spring BF' matching the stop member 6' illustrated extends only to the broken line G at the top and left hand edge of FIG. 11. The leaf spring BF' has an approximately L-shaped support member 21 in this case and the left-hand hole 23 in FIG. 11 is located between the torsion rod 14' and the adjacent hole 22.

The variation of the leaf spring BF' shown in FIGS. 11 to 13, during use of which the stop part 6' and obviously also the duct part 5 (FIG. 1) would have to be modified accordingly, is distinguished in that the measuring beam 13' and the torsion rod 14' are completely surrounded by the support member 21 and are therefore optimally protected from external influences. If the leaf spring BF' has the smaller dimensions indicated by the border G, then the measuring beam 13' as well as the torsion rod 14' lie on the outer edge of the measuring member MT (FIG. 1) and can thus be damaged by external influences. With the leaf spring BF' shown in FIGS. 11 to 13, this is prevented by the portion 21' of the support member 21 which lies outside the border G and forms a screen for measuring beam 13' and torsion rod 14'.

We claim:

1. An apparatus for measuring the thickness and irregularity of fibre slivers, preferably on machinery used in preparation for spinning, with a compression member which compresses the fibre sliver and with a measuring device which is arranged thereon, mechanically scans the compressed fibre sliver in a measuring duct and is formed by a leaf spring provided with a resistance strain gauge, for measuring the thickness and irregularity of the fibre sliver, wherein said measuring duct is provided in a measuring member arranged removably on said compression member and in that the measuring member is equipped with a compressed air nozzle provided for blowing out the settling dust and/or for cooling the measured device, said leaf spring comprising a longitudinal measuring beam which is arranged transversely to the direction of travel of the fibre sliver.

2. An apparatus for measuring the thickness and irregularity of fibre slivers, preferably on machinery used in preparation for spinning, with a compression member which compresses the fibre sliver and with a measuring device which is arranged thereon, mechanically scans the compressed fibre sliver in a measuring duct and is formed by a leaf spring arranged transversely in the direction of travel of the fibre sliver and being provided with a resistance strain gauge, for measuring the thickness and irregularity of the fibre sliver, wherein said measuring duct is provided in a measuring member arranged removably on said compression member and equipped with a compressed air nozzle provided for blowing out the settling dust and/or for cooling the measured device, said measuring member being formed by a duct part and a stop part, between which said leaf spring is clamped.

3. An apparatus according to claim 2, wherein the measuring beam is spring mounted on a support.

4. An apparatus according to claim 3, wherein the measuring beam is mounted at its ends via at least one torsion rod.

5. An apparatus according to claim 4, wherein the measuring beam is provided on its side which rests on the fibre sliver and on the opposing side with several, preferably with two, respective resistance strain gauges.

6. An apparatus according to claim 5, wherein the resistance strain gauges are arranged on each side of the measuring beam symmetrically to the longitudinal axis of the measuring duct.

7. An apparatus according to claim 4, wherein the ends of the torsion rods turned away from the measuring beam are connected via a connecting part.

8. An apparatus according to claim 4, wherein the stop part has, in the region of the measuring beam, two contact faces for the ends thereof.

9. An apparatus according to claim 8, wherein the stop part has, between the two contact faces, a web which is set back from the measuring beam for limiting the deflection of the measuring beam.

10. An apparatus according to claim 9, wherein the stop part has a U-shaped profile adjacent to its portion clamping the connecting part, the contact faces being provided on its lateral walls, and in that the compressed air nozzle is provided in one of the lateral walls for cleaning and/or cooling the interior of the measuring member and of the measuring beam.

11. An apparatus according to claim 3, wherein the measuring beam is mounted on the support directly at one end and via a torsion rod at its other end.

12. An apparatus according to claim 4, wherein, on its side lying on the fibre sliver, the measuring beam is provided in the region of the longitudinal axis of the measuring duct with a pressure plate preferably composed of hard metal or ceramic material.

13. An apparatus according to claim 12, wherein the leaf spring is produced from one piece.

14. An apparatus according to claim 11 wherein the part of the leaf spring forming the support is thicker than the measuring beam.

15. An apparatus according to claim 14, wherein the support has an L-shaped configuration and in that the measuring beam is mounted directly on one arm of the support and via the torsion rod on the other arm of the support.

16. An apparatus according to claim 15, wherein an additional member for protecting the measuring beam, and the torsion rod from external influences is provided on the support.

17. An apparatus according to claim 16, wherein the additional member also has an L-shaped configuration and is combined with the support to form a rectangular one-piece plate, and wherein the measuring beam and torsion rod are arranged in the internal portion of this plate.

18. An apparatus according to claim 11, wherein the compression member has an outlet for the fibre sliver with an oval or oblong cross section, and wherein the measuring beam is oriented parallel to one of the longer side edges of the outlet opening.

19. An apparatus according to claim 12, wherein the stop member has a contact face for the leaf spring and, in the region of the measuring beam a slope which is set back towards the contact face and is divided by a web which is arranged in the region of the pressure plate and whose face turned towards the measuring beam lies at a level between the contact face and the slope and forms a stop for the measuring beam.

20. An apparatus according to claim 19, wherein two chambers are provided in the stop member, of which the first is connected to both parts and the second to one part of the slope, wherein a respective passage in the stop member leads outward from both chambers, and wherein the passage opening into the first chamber is provided as compressed air connection and the passage opening into the second chamber is provided for guiding electric cables to resistance strain gauges arranged on the measuring beam.

21. Apparatus for sensing the thickness of fibre slivers as such slivers are being moved lengthwise of themselves in preparation for spinning, comprising a compression member which compresses the fibre sliver, and a measuring device on said compression member for mechanically scanning the compressed sliver, said measuring device including a measuring member arranged removably on said compression member, said measuring member being provided with a measuring duct for receiving the compressed sliver, a leaf spring comprising a measuring beam having its lengthwise direction disposed transversely to the direction of travel of the compressed sliver in said duct and being disposed in contact with said compressed sliver in said duct, and strain gauge means on said measuring beam for measuring the thickness of said compressed silver.

22. Apparatus according to cliam 21, wherein said measuring beam is springmounted on said measuring device by torsion rod means connected to at least one end portion of said beam.

23. Apparatus according to claim 22, including a part clamped on said measuring device and supporting portions of said torsion bar means opposite and spaced from said measuring beam.

24. Apparatus according to claim 23, including means for limiting deflection of said measuring beam.

25. Apparatus according to claim 21, wherein said measuring device is provided with compressed air nozzle means for blowing air to clean and/or cool the area of sliver measurement.

* * * * *